US010497260B1

(12) United States Patent
Grant

(10) Patent No.: US 10,497,260 B1
(45) Date of Patent: Dec. 3, 2019

(54) APPARATUS AND METHODS FOR PEDESTRIAN SIGNALING

(71) Applicant: Siemens Industry, Inc., Alpharetta, GA (US)

(72) Inventor: Jonathan S. Grant, Austin, TX (US)

(73) Assignee: SIEMENS MOBILITY, INC., New York, NY (US)

( * ) Notice: Subject to any disclaimer, the term of this patent is extended or adjusted under 35 U.S.C. 154(b) by 0 days.

(21) Appl. No.: 15/983,135

(22) Filed: May 18, 2018

(51) Int. Cl.
*G08G 1/096* (2006.01)
*G08G 1/005* (2006.01)

(52) U.S. Cl.
CPC ..... *G08G 1/096* (2013.01); *G08G 1/005* (2013.01)

(58) Field of Classification Search
CPC ..... G08G 1/096; G08G 1/005
USPC ..... 340/929
See application file for complete search history.

(56) References Cited

U.S. PATENT DOCUMENTS 6,707,391 B1 * 3/2004 Monroe ..... G08G 1/0965 340/901
6,822,581 B2 * 11/2004 Chaffe ..... G08G 1/095 340/309.3
7,855,660 B2 * 12/2010 Kim ..... G08G 1/096 340/907
8,746,086 B1 * 6/2014 Niemeyer ..... H03K 17/964 73/862
8,797,184 B2 * 8/2014 Tate ..... G08G 1/005 340/906
2017/0256161 A1 * 9/2017 Shaffer ..... G08G 1/0955

OTHER PUBLICATIONS

Grant, Jonathan S.; "TS2 Countdown Pedestrian Signals"; Nov. 5, 2012; 4 pages; Rev. 2.0; Siemens Industry, Inc.

* cited by examiner

*Primary Examiner* — John A Tweel, Jr.

(57) ABSTRACT

The present disclosure is directed to traffic control systems. Various embodiments relate to systems and methods for controlling a pedestrian signal. One method includes determining, by a control system, to change the state of a pedestrian signal from a WALK state to a pedestrian clear state. The method includes generating, by the control system, a countdown control output for controlling the countdown display of the pedestrian signal. The method includes transmitting, by the control system, the countdown control output to the pedestrian signal. The pedestrian signal thereafter controls the countdown display according to the countdown control output.

14 Claims, 7 Drawing Sheets

APPARATUS AND METHODS FOR PEDESTRIAN SIGNALING

TECHNICAL FIELD

The present disclosure is directed, in general, to traffic control systems, and more specifically to systems and methods for pedestrian signaling in traffic control systems.

BACKGROUND OF THE DISCLOSURE

Increasing populations and high demand for travel have resulted in more street intersections controlled by traffic signals. Traffic signal controlled intersections are generally accompanied by large metal boxes located near the intersection. The large, usually metal cabinet ("traffic controller cabinet" or "TCC") contains a traffic control system. The traffic control system includes indicators such as traffic signals and pedestrian signals. Improved systems are desirable.

SUMMARY OF THE DISCLOSURE

Various embodiments relate to systems and methods for controlling a pedestrian signal. One method includes determining, by a control system, to change the state of a pedestrian signal from a WALK state to a pedestrian clear state. The method includes generating, by the control system, a countdown control output for controlling the countdown display of the pedestrian signal. The method includes transmitting, by the control system, the countdown control output to the pedestrian signal. The pedestrian signal thereafter controls the countdown display according to the countdown control output.

An embodiment includes traffic control apparatus comprising a traffic control cabinet housing a control system, and a pedestrian signal having a countdown display and connected to communicate with the control system. The control system is configured to determine to change the state of a pedestrian signal from a WALK state to a pedestrian clear state, generate a countdown control output for controlling the countdown display of the pedestrian signal, and transmit the countdown control output to the pedestrian signal. The pedestrian signal is configured to control the countdown display according to the countdown control output.

An embodiment includes a pedestrian signal comprising a countdown display and a controller connected to control the countdown display. The controller is configured to receive a countdown control output for controlling the countdown display of the pedestrian signal, and control the countdown display according to the countdown control output.

In various embodiments, the countdown control output is a multi-state signal, such as a two-state signal with ON and OFF states, and a flash rate of the countdown control output defines a countdown of the countdown display. In various embodiments, a continuous ON state of the countdown control output indicates a standard pedestrian crossing time for the pedestrian clear state, an OFF state of the countdown control output indicates that the countdown display remains dark, a first flash rate of the countdown control output indicates a first alternate crossing time for the pedestrian clear state, and a second flash rate of the countdown control output indicates a second alternate crossing time for the pedestrian clear state.

In various embodiments, the countdown control output is a serial data output that defines a countdown of the countdown display. In various embodiments, the countdown control output is an asynchronous serial transmission at 10 baud with a start bit, 8 data bits, even parity, and two stop bits. In various embodiments, the data bits define a countdown starting value for the countdown of the countdown display.

In various embodiments, the control system is further configured to generate an acknowledgement signal in response to a pedestrian call signal and send the acknowledgement signal to activate an indicator on a pedestrian pushbutton.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Traffic control systems typically include traffic signals oriented to control traffic from one or more streets entering an intersection or at a crosswalk. At the intersection, there may also be traffic sensors to determine when and where traffic is entering the intersection so that the signals can be controlled intelligently with respect to traffic presence and demands.

Many traffic control systems also service pedestrians at the intersection. At these intersections, a pedestrian display will typically show "walk" or "don't walk" across one or more of the intersecting streets to guide pedestrians as to when it is safe and legal to cross the street. The traffic control system may also include pedestrian pushbuttons used by pedestrians to indicate their desire to cross the street and request that the traffic control system control the intersection so that they may safely and legally do so.

Disclosed embodiments include an apparatus, system, and method to improve pedestrian signaling and interactions in a traffic control system.

Figure 1:
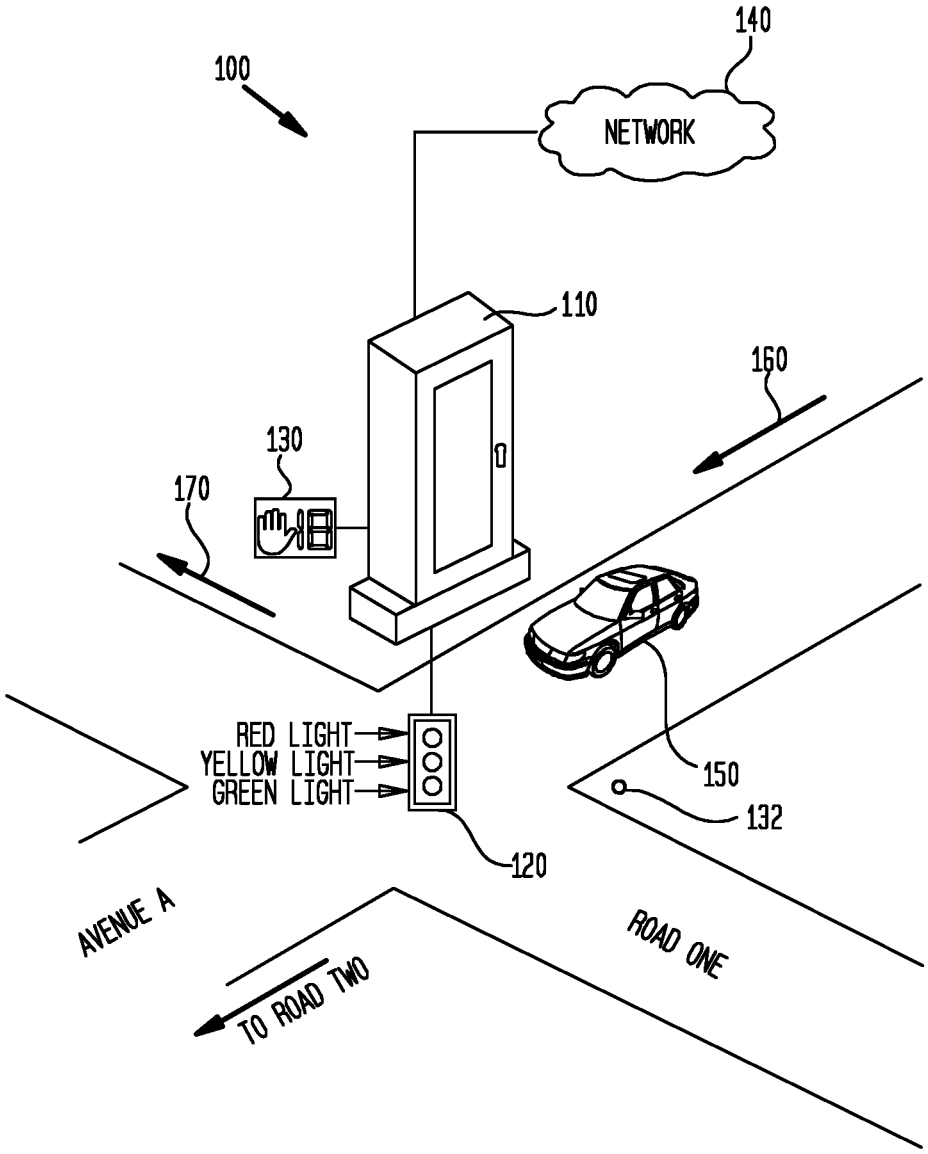
FIG. 1 illustrates a traffic-signal-controlled street intersection according to embodiments of the present disclosure.

FIG. 1 illustrates a traffic-signal-controlled street intersection 100 according to embodiments of the present disclosure. The traffic-signal-controlled street intersection 100 contains one or more traffic control cabinets 110, one or more traffic signals 120, and one or more pedestrian signals 130. Each traffic signal 120 and pedestrian signal 130 is communicably coupled to at least one TCC 110. The traffic signal controlled street intersection 100 can also include one or more pedestrian pushbuttons (or other pedestrian sensors) 132, also communicably coupled to TCC 110 (connection not shown). The communications between these elements can be performed by wired or wireless connections, including but not limited to the options described in more detail below.

Each traffic control cabinet 110 can be communicably coupled to at least one network 140. The network 140 is communicably coupled to one or more traffic control operation centers (not shown). The traffic signals 120 direct passenger vehicles 150, commercial vehicles, and emergency response vehicles (not shown) that drive on the streets. The arrows 160 and 170 indicate the direction of traffic flow on each of the intersecting streets (Avenue A and Road One).

Traffic signals 120 pass through a sequence of states. One sequence of traffic signal states may include a red light state followed by a green light state followed by a yellow light state followed by a return to the red light state. Another sequence of traffic signal states may include a red-light-red-left-turn-signal state followed by a red-light-green-left-turn-signal state followed by a red-light-yellow-left-turn-signal state followed by a green light state followed by a yellow light state followed by a return to the red-light-red-left-turn-signal state. One skilled in the art will appreciate that a traffic signal may traverse through a different sequence of traffic signal states. The traffic signal 120 is configured to send a signal indicating the state of the traffic signal 120 to the TCC 110.

Similarly, pedestrian signals 130 pass through a sequence of states to direct pedestrian traffic. These states may include "walk" and "don't walk" states that are indicated by words or symbols. These states may include warning states such as a "pedestrian clear" (or "pedestrian change") state with a flashing "don't walk" indicator indicating that the pedestrian signal is preparing to transition from a "walk" state to a "don't walk" state. A pedestrian signal generally has three states with corresponding displays: A "walk" state showing a steady walking person or steady "WALK", a "pedestrian change" state showing a flashing upraised hand or flashing "DON'T WALK", and a "don't walk" state showing a steady upraised hand or steady "DON'T WALK". At the beginning of the pedestrian change state, the countdown timer lights up and operates. The timer displays how many seconds remain until the end of the pedestrian clear interval and the beginning of the don't walk state. In particular, pedestrian signals 130 can include a countdown indicator as described herein that indicates the time until the pedestrian signal 130 changes states.

Figure 2:
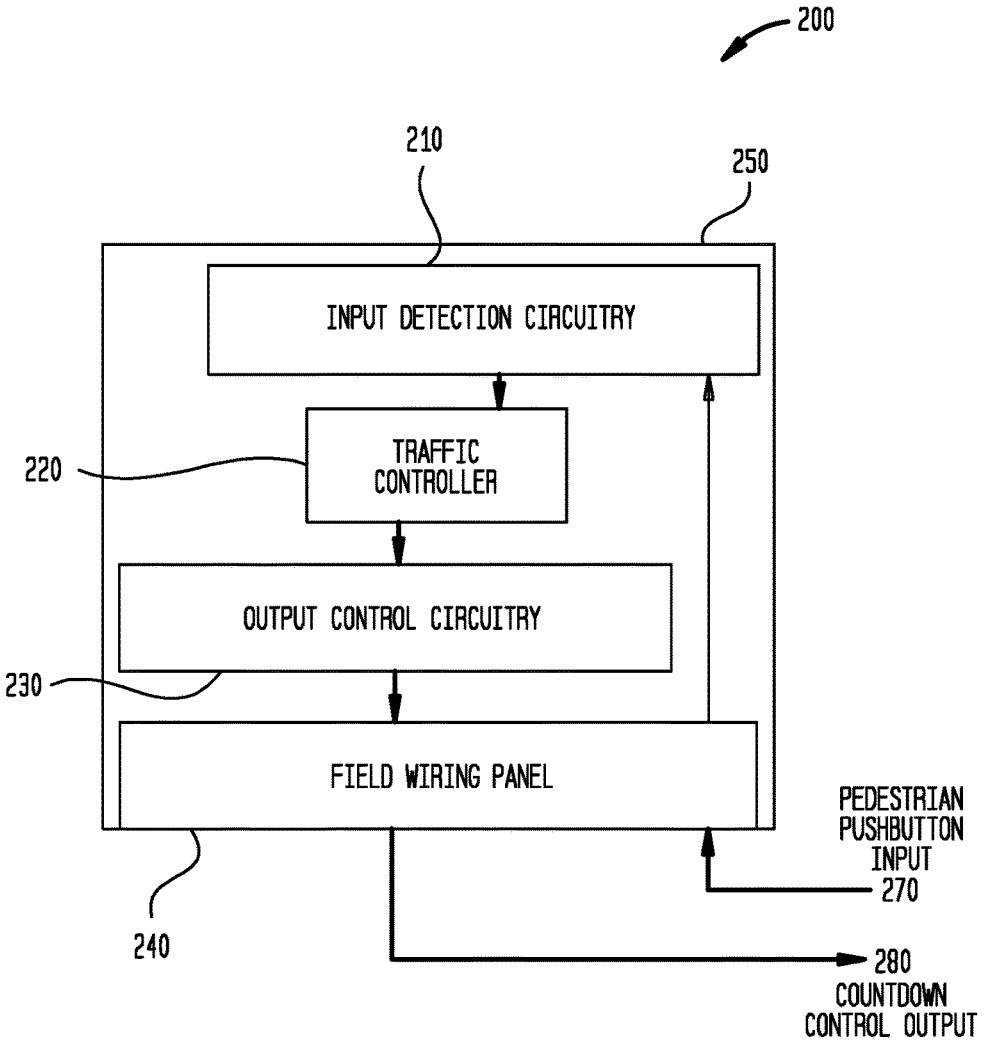
FIG. 2 illustrates a block diagram of selected electrical and electronic components of a traffic control cabinet in accordance with disclosed embodiments.

FIG. 2 illustrates a block diagram of selected electrical and electronic components of the TCC 110. Although certain details will be provided with reference to the components of the control system 200 of FIG. 2, it should be understood that other embodiments may include more, less, or different components. The TCC 110 includes the control system 200. The traffic control system 200 is configured to enable the TCC 110 to provide electronic dissemination of information to street traffic. In other embodiments, traffic control system 200 can be physically implemented in other devices or cabinets.

Control system 200 includes input detection circuitry 210, a traffic controller 220, output control circuitry 230, and field wiring panel 240. The control system 200 may also include a telephone. The control system 200 is configured to control one or more functions of the TCC 110, including providing electronic dissemination of information to street traffic and pedestrian traffic.

Field wiring panel is connected to various inputs and outputs, including, for purposes of this disclosure, pedestrian pushbutton input 270 and countdown control output 280.

Traffic controller 220, output control circuitry 230, and field wiring panel 240 provide instructions to traffic signal 120 and pedestrian signal 130 and receive pedestrian pushbutton input 270. Traffic controller 220 controls the countdown control output 280 as described herein to pedestrian signals.

The traffic controller 220 includes a memory. The memory may include any suitable volatile or non-volatile storage and retrieval device(s). For example, the memory can include any electronic, magnetic, electromagnetic, optical, electro-optical, electro-mechanical, and/or other physical device(s) that can contain, store, communicate, propagate, or transmit information. The memory can store data and instructions for use by the traffic controller 220.

In some embodiments, pedestrian pushbuttons 132 (including related pedestrian sensors and input devices) can include or be associated with an indicator, such as a light or other display, on the pushbutton-side of the intersection.

That is, most pedestrian call buttons have no indication whatever that the button has been successfully pressed and the "request" has been sent to the traffic control system.

Some pedestrian pushbuttons do provide a light and sometimes audible acknowledgement, but this merely acknowledges that the contact closure has been successfully made within the module. It does not provide confirmation that the traffic control system itself has recognized the call and will service it. In cases where the call button wiring has failed or where pedestrian service has been disabled, users get a false notion that pedestrian service will occur soon. When it doesn't, they are more likely to cross at an inappropriate time. More dangerously, they will tend to forgo placing pedestrian calls at other intersections, believing it to be a waste of time and effort.

Intersections equipped for Manual on Uniform Traffic Control Devices (MUTCD) alternate crossing time operation require that the user press and hold the call button for more than one second, as described in 2009 MUTCD § 4E.08 ¶18: "At signalized locations with a demonstrated need and subject to equipment capabilities, pedestrians with special needs may be provided with additional crossing time by means of an extended pushbutton press."

Disclosed embodiments provide a way to confirm not only that the call has been acknowledged by the controller but that the longer alternate pedestrian service (that is, a longer "walk" state crossing period) will be provided.

Figure 3:
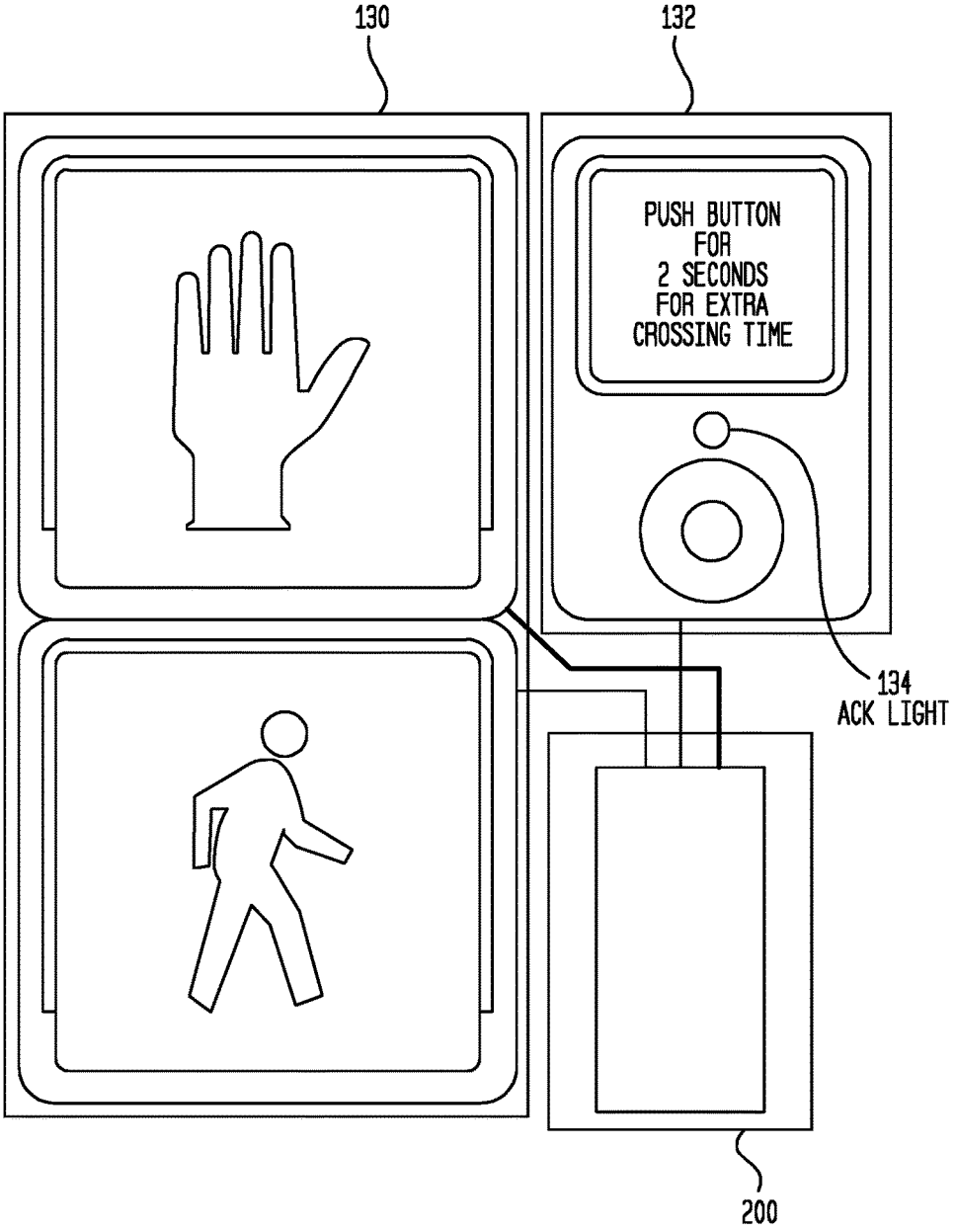
FIG. 3 illustrates an example of pedestrian notification in accordance with disclosed embodiments.

FIG. 3 illustrates an example of pedestrian notification in accordance with disclosed embodiments. This figure shows an example of a pedestrian signal 130 with walk/don't walk indicators, a traffic control system 200, and a pedestrian pushbutton 132. In this example, the pedestrian pushbutton includes an indicator 134 such as an acknowledgement (ack) light.

In typical traffic cabinets, the Green output of the pedestrian loadswitch drives the "Walk" (Walker) section and the Red output drives the "Don't Walk" (Hand) section of the pedestrian signal. In most cases the Yellow output of the loadswitch remains unused. In addition, most intersections installed in the last 20 years include spare conductors which would be available to carry this output to the pedestrian pushbutton module.

A Positive Pedestrian Call Acknowledgement (PPCA) output as disclosed herein can make use of this conductor. In some embodiments, when the pedestrian call button is pressed and released, the PPCA output of traffic control system 200 is turned on by the traffic controller 220 when it has scheduled the call for service. If the call button is held long enough to engage the alternate pedestrian service, the output is made to flash.

In this way, after the pedestrian has pushed the pedestrian pushbutton 132, the indicator 134 is activated (e.g., lighted) to indicate that the request has been received and the pedestrian crossing state has been scheduled. In other cases, when the alternate pedestrian service has been scheduled, indicator 134 can be activated in a different fashion, such as a flashing light. Of course, in other cases, indicator 134 can include multiple individual lights, one to indicate a scheduled regular pedestrian service and another to indicate a scheduled alternate pedestrian service.

The MUTCD also mandates the use of countdown pedestrian signals, stating that all pedestrian signal heads used at crosswalks where the pedestrian change interval is more than seven seconds shall include a pedestrian change interval countdown display in order to inform pedestrians of the number of seconds remaining in the pedestrian change interval.

Currently, National Electrical Manufacturers Association (NEMA) controllers have no standard way to directly drive this countdown display or to inform the logic within the signal head of the length of the pedestrian change interval (also known as the "pedestrian clearance time"). Standard traffic signal controllers currently have no way to directly drive the counter of such displays or to inform the counter's logic of the duration of the upcoming pedestrian change interval, e.g., flashing "Don't Walk" (or flashing Hand).

Some pedestrian displays can learn this duration by timing the pedestrian change interval for two traffic cycles and presuming that the next cycle will be the same. While this works well in many cases, it fails when the intersection uses more than one duration for the pedestrian change interval. This can occur when the intersection is equipped with an alternate crossing time that may be actuated occasionally by special needs pedestrians as described above. It also fails for intersections equipped with alternate change interval times used for active school zones, or during transit priority or rail/emergency vehicle preemption operation.

Figure 4:
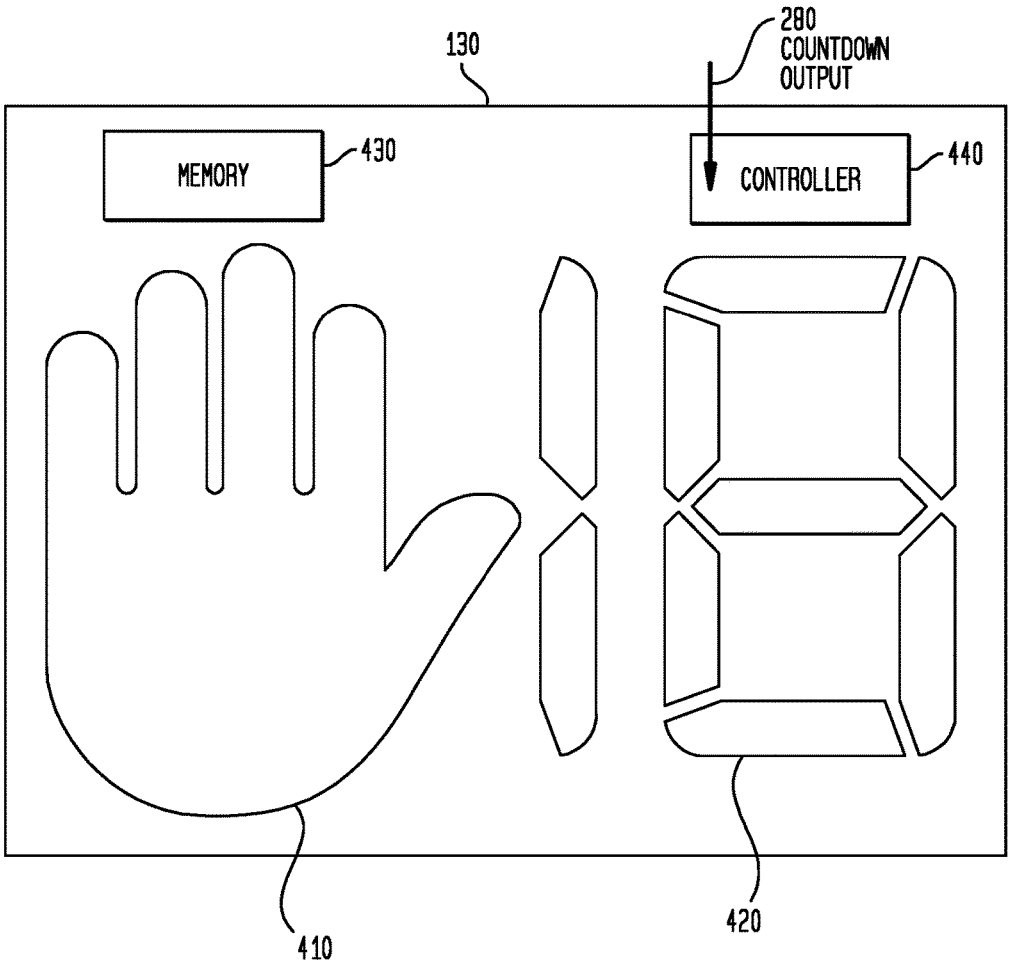
FIG. 4 illustrates an example of a pedestrian signal in accordance with disclosed embodiments.

FIG. 4 illustrates an example of a pedestrian signal 130 that has both a walk/don't walk indicator 410 (shown here in the "don't walk" state) and a countdown indicator 420 (shown here with a remaining countdown time of 18 seconds). Walk/don't walk indicator 410 and a countdown indicator 420 are visible to pedestrians. In some embodiments, the pedestrian signal can be "dumb" in that all logical processing and control of the indicators is performed by the traffic control system.

In other embodiments, however, the pedestrian signal 130 itself has a memory 430 and controller 440 (contained, not visible to pedestrians) that receives the countdown control output as described herein and operates the walk/don't walk indicator 410 and countdown indicator 420 accordingly. The memory 430 and controller 440 can be configured to perform processes as described herein and may be referred to generically herein as the "counter logic." Controller 440 can be connected to receive the countdown control output 280 (which of course is then a countdown input to controller 440, so these terms may be used interchangeably).

One procedure to address this issue is to extend the pedestrian clearance time, so as not to leave slower pedestrians left in the crosswalk even if they entered during the last second of Walk. The current "learning" type signal heads are clearly not appropriate for this mode of operation. As more controller manufacturers support the extended crossing time feature, and as more agencies begin to require it, it is clear that: the signal controller needs some way to directly drive or to indirectly manage the pedestrian countdown display such that an accurate countdown may be given in all but the most abrupt preemptions.

As described above, in most cases the Yellow output of the traffic control system remains unused. In addition, most intersections installed in the last twenty years include spare conductors that can be used to carry a countdown control output to the pedestrian signal 130. For consistent reference, whichever signal or connection is used to connect the traffic control system to the countdown indicator 420 (or pedestrian signal 130 and its counter logic) is referred to herein as the "countdown control output."

The pedestrian yellow output can be used to drive the countdown control output (and connect to a corresponding countdown input on the countdown head, such as at controller 440 of pedestrian signal 130). The updated pedestrian signal 130 can learn and count down at least two different clearance times, selected by the state and flash rate applied to the countdown input/output at the beginning of pedestrian clearance. The countdown control output would become active at the beginning of pedestrian clearance, turn off at the end of pedestrian clearance, and remain off for the remainder of the cycle.

For example, a continuous ON of the countdown control output can cause the controller 440 to learn or count down the standard clearance time. A countdown control output of 60 flashes per minute can cause the controller 440 to learn or count down the extended clearance time. When the countdown control output remains OFF, the countdown display remains dark.

For example, a continuous ON of the countdown control output can cause the controller 440 to make the countdown indicator 420 remain dark because the change interval is neither standard nor extended.

If the output changes from its initial behavior at any time during pedestrian clearance, the countdown indicator 420 can immediately go dark.

Disclosed embodiments provide an improved traffic control system and pedestrian signal in that multiple different pedestrian clearance times are supported by the pedestrian signal. Disclosed embodiments can use of existing equipment in the traffic control cabinet and can exploit existing but typically unused output. The countdown control output/input may be tied to Don't Walk to allow updated countdown heads to be installed at existing intersections in advance of wiring and controller changes.

In some disclosed embodiments, the countdown control output is used to control signaling based on the ON/OFF status of the countdown control output and ON/OFF pulses transmitted over the countdown control output. The signaling or "flash" rates of the pulsed countdown control output in the example shown in Table 1 are within the usual operational range of any traffic signal controller:

TABLE 1

Example Flash Rates and Usage Examples

| Flash Rate[per minute] | Countdown Display Function | Usage Example |
|---|---|---|
| ON[0] | Learn or count down 1st pedestrian change interval | standard pedestrian crossing time[0] |
| 60[1] | Learn or count down 2nd pedestrian change interval | alternate MUTCD special-needs crossing time |
| 75[2] | Learn or count down 3rd pedestrian change interval | alternate time for active school zone |
| 100[2] | Learn or count down 4th pedestrian change interval | alt. time during emergency vehicle preempt |
| 150[2] | Learn or count down 5th pedestrian change interval | alt. time during light rail priority operation |
| 300[2] | Learn or count down 6th pedestrian change interval | spare |
| OFF[1] | Counter remains dark; ignore this change interval | heavy rail or other preempts |

[0]Used for backward compatibility with existing controllers
[1]Used to provide minimal functionality
[2]Optional flash rates based on 50% duty cycle and 100 ms steps The flash rates illustrated in Table 1 describe one exemplary disclosed signaling implementation for the countdown control output. This example permits up to six different durations to be distinguished as well as signaling the counter to remain dark. This example presumes a 50% duty cycle and that the controller can change states only in even multiples of 100 milliseconds. Other duty cycles and flash rates could be used as well within the scope of the disclosure.

Preferably, at least a standard pedestrian change interval, one alternate interval, and the ability to omit the countdown should be supported. If fewer intervals are supported, flash rates may be selected for ease of recognition by the counter logic. For example the circuit to distinguish 60 fpm from 100 fpm might be more economical than that to distinguish 60 fpm from 75 fpm.

A traffic control system with a countdown pedestrian display as disclosed is preferably configured learn and display, on countdown indicator 420, two or more different intervals or to remain dark as signaled by the controller via the load switch. This signaling could occur either before the beginning of the pedestrian change interval or during the first second of that interval.

Disclosed embodiments provide for countdown duration signaling during pedestrian change interval. For this example, the countdown control output begins signaling at the start of the pedestrian change interval. The counter remains dark while the counter logic samples the countdown control output during the first second of the interval. The counter then lights up with the correct remaining time. The countdown control output continues to signal consistently throughout the interval, then turns off to tell the countdown display to go dark. This behavior is shown in Table 1.

Figure 5:
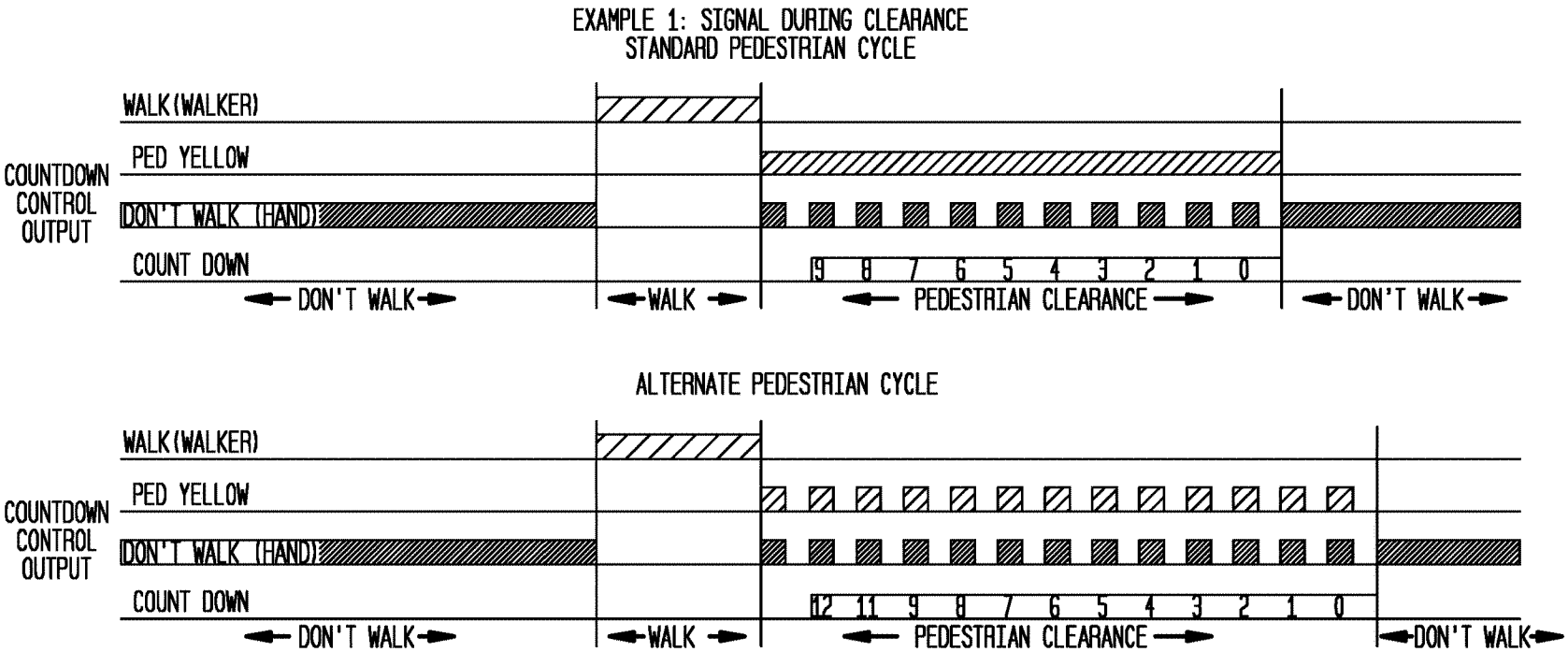
FIG. 5 illustrates exemplary timing charts in accordance with disclosed embodiments.
Figure 5:
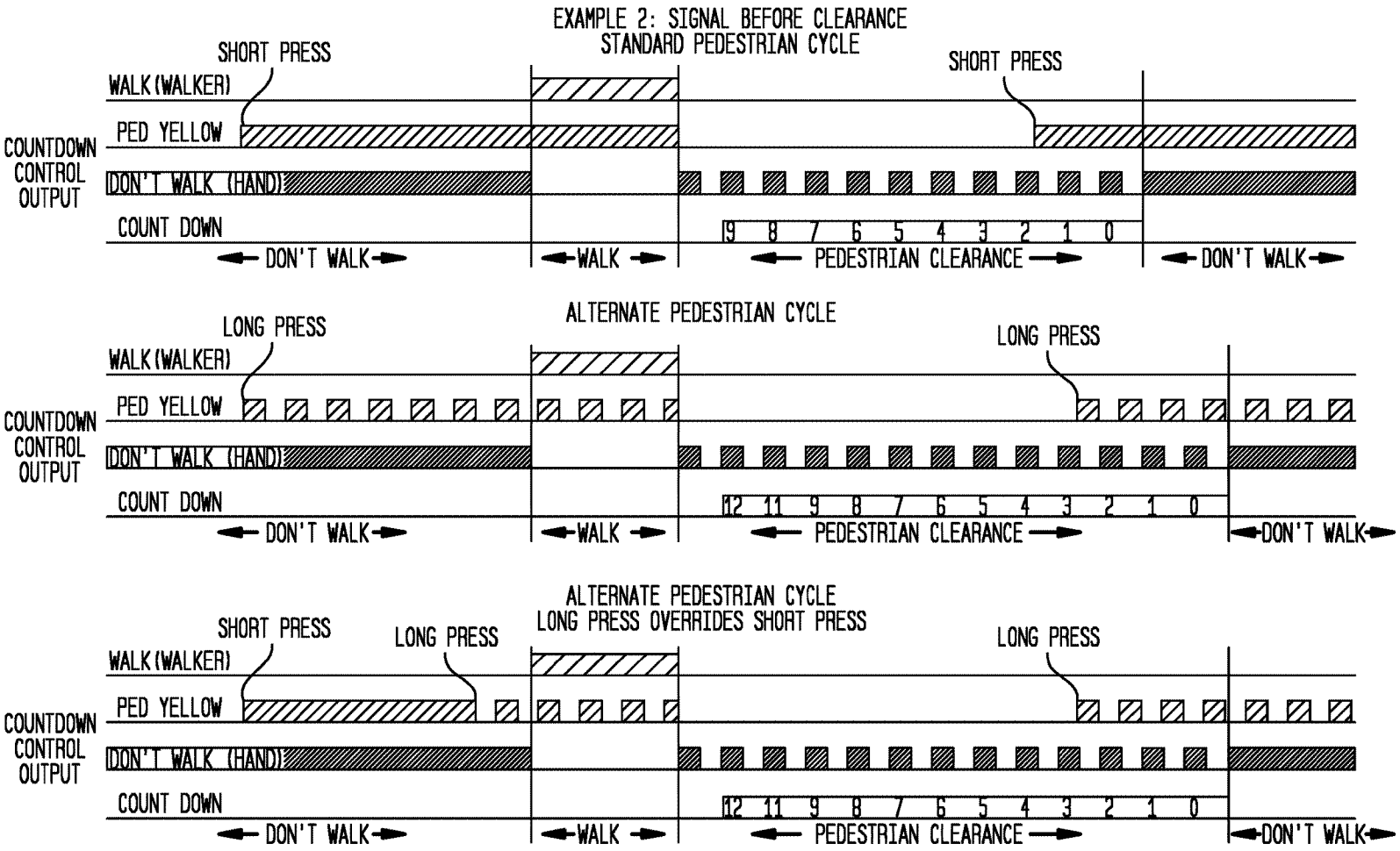

FIG. 5 illustrates exemplary timing charts for the Walk indicator (commonly a "walker" icon), the countdown control output, the Don't Walk indicator (commonly a hand as illustrated as walk indicator 410 in FIG. 4), and the actual countdown display (such as countdown indicator 420 FIG. 4). This figure illustrates the status of each signal/indicator during the Don't Walk, Walk, and Pedestrian Clearance states.

If the countdown control output changes its operation at any time during the pedestrian change interval, the countdown display immediately goes dark. Example 1 in FIG. 5 shows an example of timing charts for countdown duration signaling during pedestrian change interval, during both a standard pedestrian cycle and an alternate pedestrian cycle.

Disclosed embodiments also provide for countdown duration signaling before pedestrian change interval. For this example, the countdown control output begins signaling as soon as a pedestrian call is received at the controller. The counter logic, whether implemented in the traffic control system or the pedestrian signal 130 itself, samples the countdown control output continuously and operates based on the rate seen just before the pedestrian change interval, such as shown in Table 1.

The countdown control output turns off at the beginning of the pedestrian change interval and the counter immediately lights up with the correct time and begins counting.

Note that this example permits the countdown control output to also drive a Positive Pedestrian Call Acknowledge (PPCA) light as described above. If the PPCA feature is not required, turning on the countdown control output at any time during the pedestrian change interval would cause the countdown display to immediately go dark.

Example 1 in FIG. 5 shows an example of timing charts for countdown duration signaling during pedestrian change/clearance interval, during both a standard pedestrian cycle and an alternate pedestrian cycle. This figure shows the activation of the Walk signal, the Don't Walk signal (including flashing), the value shown on the countdown display, and the state of the countdown control output from the traffic control circuitry. In this example, for a standard pedestrian cycle, the countdown control output stays ON when the pedestrian signal changes from a WALK signal to a flashing DON'T WALK signal, which indicates that the state of the signal is preparing to change to DON'T WALK. The continuous ON of the countdown control output, in this example, causes a standard countdown (in this case, from 9 to 0) on the countdown display.

In this example, for an alternate pedestrian cycle, the countdown control output pulses (or flashes) when the pedestrian signal changes from a WALK signal to a flashing DON'T WALK signal, which indicates that the state of the signal is preparing to change to DON'T WALK. The pulsing of the countdown control output, in this example, causes an extended countdown (in this case, from 12 to 0) on the countdown display.

Example 2 in FIG. 5 shows an example of timing charts for countdown duration signaling before pedestrian change/clearance interval, during both a standard pedestrian cycle and an alternate pedestrian cycle. This figure shows the activation of the Walk signal, the Don't Walk signal (including flashing), the value shown on the countdown display, and the state of the countdown control output from the traffic control circuitry. In this example, for a standard pedestrian cycle, the countdown control output begins pulsing before the pedestrian signal changes from a WALK signal to a flashing DON'T WALK signal, and the number or rate of the pulses/flashes indicate the length of the pedestrian clearance time. Table 1 above shows examples of the use of the flash rate to signal multiple pedestrian change intervals. Based on the rate, the controller of the pedestrian signal causes a standard, extended, or other countdown on the countdown display.

In other embodiments, instead of using the flash rate of pulses on the countdown control output, the countdown control output can be used for serial data transmission.

One example embodiments of such an approach uses an asynchronous serial transmission at 10 baud with a start bit, 8 data bits, even parity, and two stop bits. Data bits are transmitted least-significant bit first. The electrical convention in this example is that countdown control output ON is considered to be MARK and countdown control output OFF is considered to be SPACE. The value may be transmitted once or many times before the start of the pedestrian change interval. The line must hold MARK for at least one second (10 bit times) prior to the first start bit. It must also hold MARK between bytes until the beginning of the pedestrian change interval. At that point it must change to SPACE and remain for at least one second.

Table 2 illustrates exemplary data value ranges and actions for such an approach:

TABLE 2

Suggested Timing Value Allocations

| Value | Display Function |
|---|---|
| No Data | Legacy operation for backward compatibility |
| 0 | Counter to remain dark |
| 1-250 | Counter begins at this value (1-250 seconds) |
| 251-255 | Reserved for future applications |

Other embodiments can include direct control via serial connection and Secondary Service messages. Secondary Service messages (Types 4x, 169-172) can be used to directly program and activate the countdown head by way of the bus interface unit (BIU)-to-Rack communication port on the terminals and facilities (T&F) 1 BIU. This port is currently a reserved for all T&F BIUs, so there would be no possibility of conflict. It is an unbalanced signal and operates at 9600 baud asynchronous. This signal can go through an EIA-232 to EIA-485 converter with optical isolation, and from there via twisted pair to each countdown head. Such an approach provides for direct programming or second by second control of the countdown head, permits accurate countdown even during irregular events, does not use any load switch channels, does not take up a serial port on the controller, and fiber optics can also be used for better isolation.

Other embodiments can include direct control via signal phase and timing (SPaT) messages. In such embodiments, the same SPaT messages broadcast to vehicles also directly control countdown timer heads. Each head would include a DSRC receiver and antenna. Such an approach requires no additional controller programming required once an intersection is SPaT equipped, and no pulling of new wire for retrofits.

Figure 6:
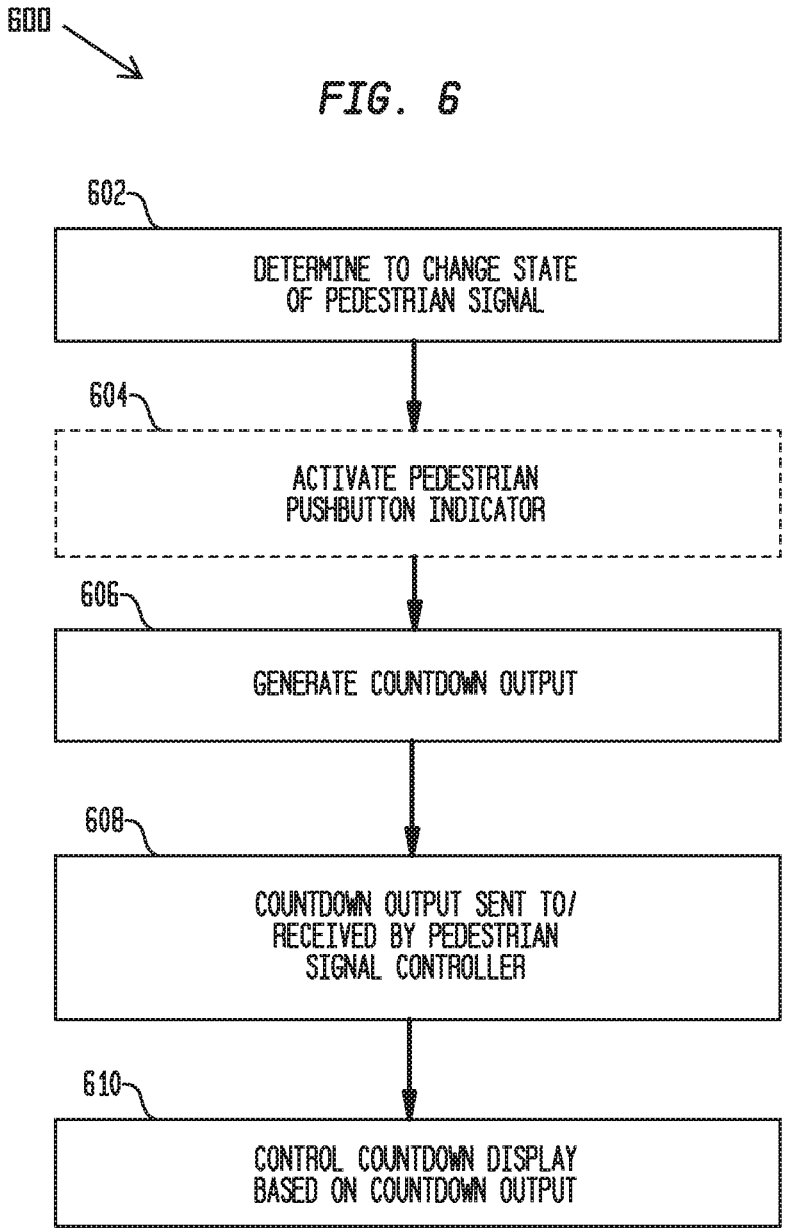
FIG. 6 illustrates a flowchart of a process in accordance with disclosed embodiments.

FIG. 6 illustrates a flow chart of a process and method 600 for control of a pedestrian signal in accordance with disclosed embodiments.

The control system (for example control system 200) determines to change the state of a pedestrian signal from a WALK state to a PEDESTRIAN CLEAR state (prior to the DON'T WALK state) (602). This can be, for example, in response to receiving a pedestrian call signal, the detection of traffic in the roadway controlled by the control system, in response to detecting an emergency vehicle, or otherwise.

If the control system had received a pedestrian call signal, the control system can generate an acknowledgement signal and send the acknowledgement signal to activate an indicator on a pedestrian pushbutton (604).

The control system generates a countdown control output for controlling a countdown display on a pedestrian signal (606). In various embodiments, the countdown control output provides starting value for the countdown display by one of several methods. The pedestrian signal itself then runs the countdown display without need of further intervention. The control system may intervene to turn off the counter.

The countdown control output is transmitted from the control system to a controller of a pedestrian signal (608) and is received by the controller of the pedestrian signal.

The controller of the pedestrian signal controls a countdown display according to the countdown control output (610). This can be performed in any of the manners disclosed herein.

Of course, those having skill in the art will recognize that, unless specifically indicated or required by the sequence of operations, certain steps in the processes described above may be omitted, performed concurrently or sequentially, or performed in a different order.

Those skilled in the art will recognize that, for simplicity and clarity, the full structure and operation of all electrical circuitry suitable for use with the present disclosure is not being depicted or described herein. Instead, only so much of electrical circuitry as is unique to the present disclosure or necessary for an understanding of the present disclosure is depicted and described. The remainder of the construction and operation of the various devices described herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC § 112 unless the exact words "means for" are followed by a participle.

What is claimed is:

1. A traffic control apparatus comprising:

a traffic control cabinet housing a control system; and a pedestrian signal having a countdown display and connected to communicate with the control system;

wherein the control system is configured to:

determine to change the state of a pedestrian signal from a WALK state to a pedestrian clear state, generate a countdown control output for controlling the countdown display of the pedestrian signal, and transmit the countdown control output to the pedestrian signal;

wherein the pedestrian signal is configured to control the countdown display according to the countdown control output;

wherein the countdown control output is a multi-state signal, and a flash rate of the countdown control output defines a countdown of the countdown display; and wherein:

a continuous ON state of the countdown control output indicates a standard pedestrian crossing time for the pedestrian clear state;

an OFF state of the countdown control output indicates that the countdown display remains dark;

a first flash rate of the countdown control output indicates a first alternate crossing time for the pedestrian clear state; and a second flash rate of the countdown control output indicates a second alternate crossing time for the pedestrian clear state.

2. The traffic control apparatus of claim 1, wherein the countdown control output is a serial data output that defines a countdown of the countdown display.

3. The traffic control apparatus of claim 2, wherein the countdown control output is an asynchronous serial transmission at 10 baud with a start bit, 8 data bits, even parity, and two stop bits.

4. The traffic control apparatus of claim 3, wherein the data bits define a countdown starting value for the countdown of the countdown display.

5. The traffic control apparatus of claim 1, wherein the control system is further configured to generate an acknowledgement signal in response to a pedestrian call signal and send the acknowledgement signal to activate an indicator on a pedestrian pushbutton.

6. A pedestrian signal comprising:

a countdown display; and a controller connected to control the countdown display, wherein the controller is configured to:

receive a countdown control output for controlling the countdown display of the pedestrian signal, and control the countdown display according to the countdown control output, wherein the countdown control output is a multi-state signal, and a flash rate of the countdown control output defines a countdown of the countdown display, and wherein:

a continuous ON state of the countdown control output indicates a standard pedestrian crossing time for a pedestrian clear state;

an OFF state of the countdown control output indicates that the countdown display remains dark;

a first flash rate of the countdown control output indicates a first alternate crossing time for the pedestrian clear state; and a second flash rate of the countdown control output indicates a second alternate crossing time for the pedestrian clear state.

7. The pedestrian signal of claim 6, wherein the countdown control output is a serial data signal that defines a countdown of the countdown display.

8. The pedestrian signal of claim 7, wherein the countdown control output is an asynchronous serial signal at 10 baud with a start bit, 8 data bits, even parity, and two stop bits.

9. The pedestrian signal of claim 8, wherein the data bits define a countdown starting value for the countdown of the countdown display.

10. A method for controlling a pedestrian signal, comprising:

determining, by a control system, to change the state of a pedestrian signal from a WALK state to a pedestrian clear state, generating, by the control system, a countdown control output for controlling the countdown display of the pedestrian signal, and transmitting, by the control system, the countdown control output to the pedestrian signal;

wherein the pedestrian signal thereafter controls the countdown display according to the countdown control output, wherein the countdown control output is a multi-state signal, and a flash rate of the countdown control output defines a countdown of the countdown display, and wherein:

a continuous ON state of the countdown control output indicates a standard pedestrian crossing time for the pedestrian clear state;

an OFF state of the countdown control output indicates that the countdown display remains dark;

a first flash rate of the countdown control output indicates a first alternate crossing time for the pedestrian clear state; and a second flash rate of the countdown control output indicates a second alternate crossing time for the pedestrian clear state.

11. The method of claim 10, wherein the countdown control output is a serial data output that defines a countdown of the countdown display.

12. The method of claim 11, wherein the countdown control output is an asynchronous serial transmission at 10 baud with a start bit, 8 data bits, even parity, and two stop bits.

13. The method of claim 12, wherein the data bits define a countdown starting value for the countdown of the countdown display.

14. The method of claim 10, further comprising generating, by the control system, an acknowledgement signal in response to a pedestrian call signal and sending the acknowledgement signal to activate an indicator on a pedestrian pushbutton.

* * * * *